US005620106A

United States Patent [19]

Storzek

[11] Patent Number: 5,620,106

[45] Date of Patent: Apr. 15, 1997

[54] MODEL RAILROAD CAR COUPLER

[75] Inventor: Dennis Storzek, Big Rock, Ill.

[73] Assignee: Accurail, Inc., Elburn, Ill.

[21] Appl. No.: 587,384

[22] Filed: Jan. 16, 1996

[51] Int. Cl.[6] ..... B61G 3/04

[52] U.S. Cl. ..... 213/75 TC

[58] Field of Search ..... 213/75 R, 75 TC, 213/100 R, 104

[56] References Cited

U.S. PATENT DOCUMENTS

| | | | |
|---|---|---|---|
| D. 326,693 | 6/1992 | Gramera . | |
| 2,318,741 | 6/1943 | Bowen et al. . | |
| 2,411,394 | 11/1946 | Strayer . | |
| 2,617,541 | 11/1952 | Goode . | |
| 2,631,739 | 3/1953 | Bonanno . | |
| 2,868,393 | 1/1959 | Bailey . | |
| 2,933,201 | 4/1960 | Anderson . | |
| 2,987,851 | 6/1961 | Bonanno . | |
| 3,069,023 | 12/1962 | Ross . | |
| 3,111,229 | 11/1963 | Edwards et al. . | |
| 3,115,255 | 12/1963 | Edwards et al. . | |
| 3,117,676 | 1/1964 | Edwards et al. . | |
| 3,140,783 | 7/1964 | Kretzmer et al. . | |
| 3,140,784 | 7/1964 | Goldbeck et al. . | |
| 3,160,286 | 12/1964 | Wilson . | |
| 3,397,483 | 8/1968 | Lingard . | |
| 3,450,272 | 6/1969 | Munzing . | |
| 3,469,713 | 9/1969 | Edwards et al. . | |
| 3,518,790 | 7/1970 | Zamarra . | |
| 3,564,766 | 2/1971 | Edwards et al. . | |
| 3,605,332 | 9/1971 | Stepek . | |
| 3,608,237 | 9/1971 | Richter . | |
| 3,609,912 | 10/1971 | Ernst . | |
| 3,619,941 | 11/1971 | Ernst . | |
| 3,662,489 | 5/1972 | Terrier . | |
| 3,678,618 | 7/1972 | Beny et al. . | |
| 3,831,776 | 8/1974 | Antonik | 213/75 TC |
| 3,840,127 | 10/1971 | Edwards et al. | 213/75 TC |
| 3,939,989 | 2/1976 | Thomson | 213/75 TC |
| 3,942,648 | 3/1976 | Edwards et al. | 213/75 TC |
| 4,098,411 | 7/1978 | Rossler | 217/75 TC |
| 4,335,820 | 6/1982 | Gramera . | |
| 4,512,483 | 4/1985 | Crossley et al. | 213/75 TC |
| 4,650,081 | 3/1987 | Diller | 213/75 TC |
| 4,765,496 | 8/1988 | Diller | 213/75 TC |
| 4,768,663 | 9/1988 | Schuller | 213/75 TC |
| 4,893,716 | 1/1990 | Diller | 213/75 TC |
| 5,090,332 | 2/1992 | Edwards et al. | 105/157.2 |
| 5,316,158 | 5/1994 | Dunham et al. | 213/75 TC |
| 5,509,546 | 4/1996 | Staat | 213/75 TC |

*Primary Examiner*—S. Joseph Morano
*Attorney, Agent, or Firm*—McAndrews, Held & Malloy, Ltd.

[57] ABSTRACT

A model railroad car coupler having a box and drawbar formed of a pair of shanks. The shanks are disposed vertically with respect to one another and independently rotatable relative to a pivot axis. The distal end of one shank carries a knuckle and the distal end of the other shank includes a lip. Biasing springs attached to the proximal end of each shank cooperate with the coupler box for biasing its respective shank about a pivot axis. The extent of the relative motion of the two shanks are limited by a controller. In a preferred embodiment, the controller comprises a boss and guide surface.

20 Claims, 9 Drawing Sheets

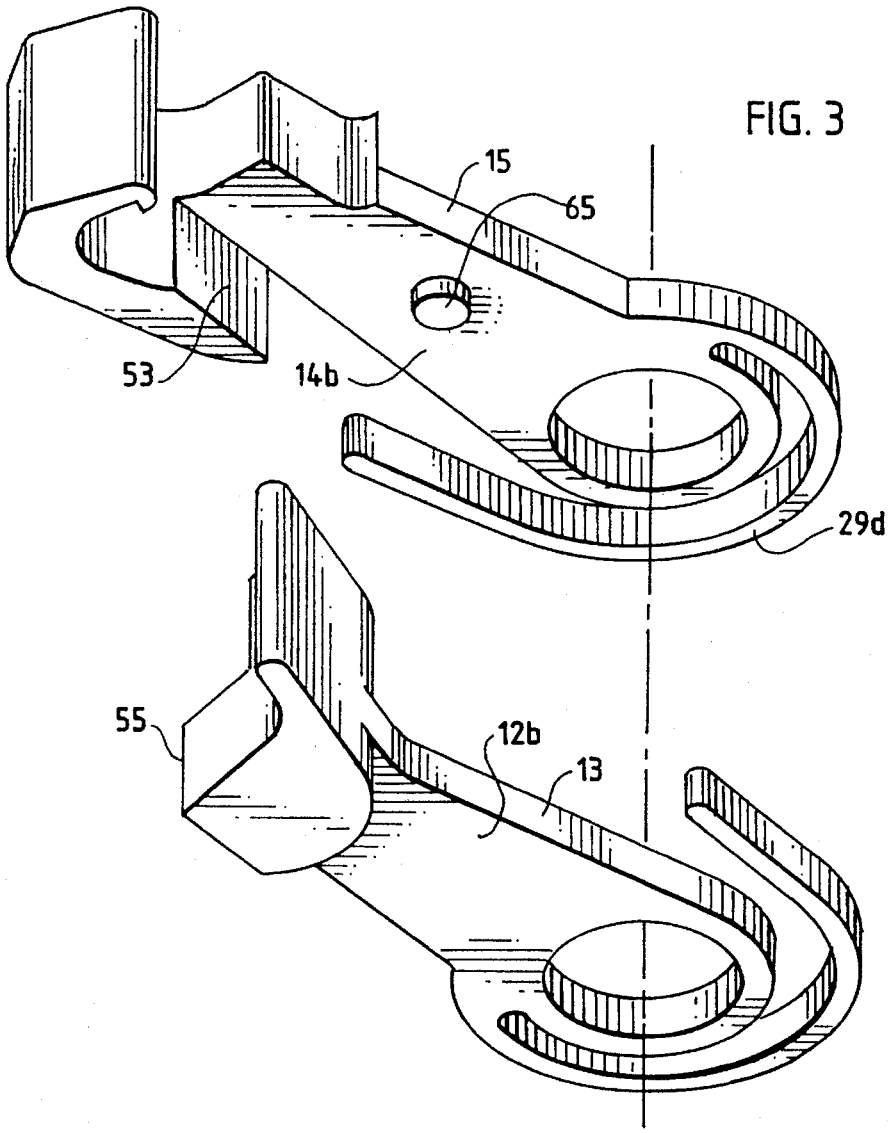
FIG. 3
FIG. 4
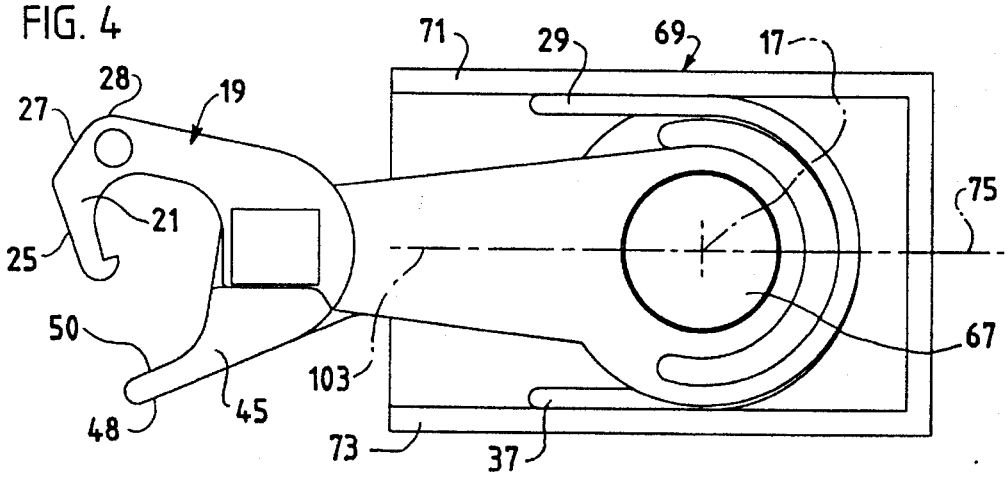

FIG. 6A
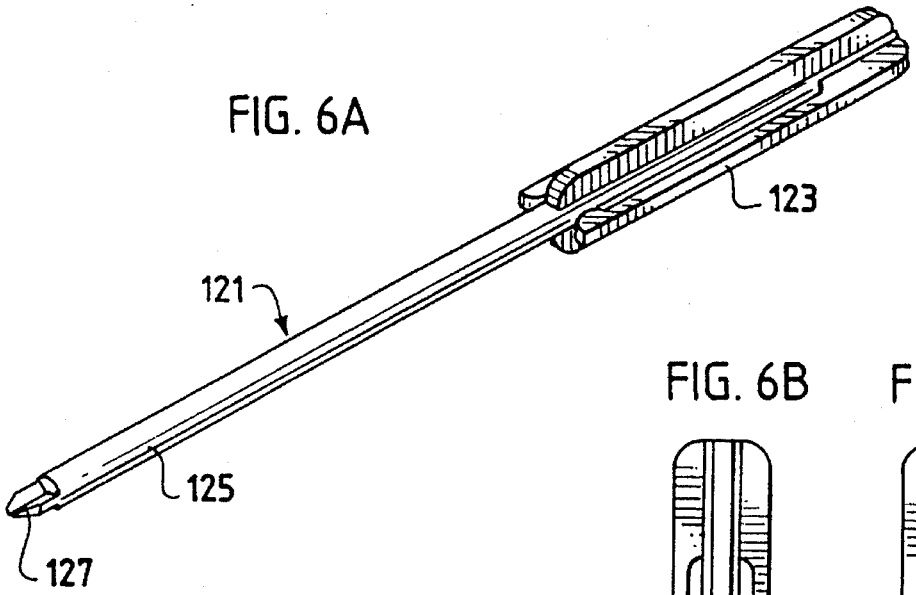
FIG. 6B
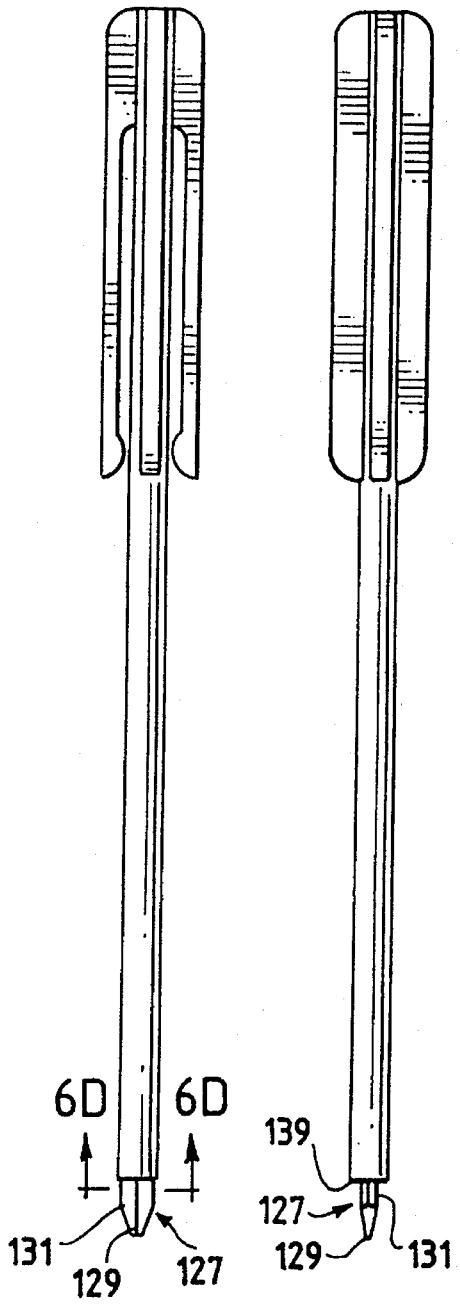
FIG. 6C
FIG. 6D
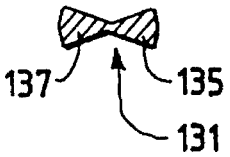
FIG. 6E
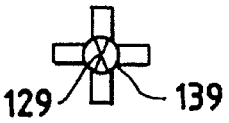

MODEL RAILROAD CAR COUPLER

BACKGROUND OF THE INVENTION

The invention relates to a coupler for a model railroad car and more particularly to a drawbar for such a coupler.

Scale models of railroad equipment have been built almost since the inception of railroads themselves. The attraction is not only the satisfaction derived from the construction of the model, but also from seeing the models actually move in a miniature replication of the real world.

Couplers for use on scale model railroad equipment (the parts that hold the individual cars together into a train) should meet three main criteria. They must (1) couple together automatically when pushed together, (2) have the ability to be uncoupled in some fashion, and (3) be cost effective to manufacture. In addition to this, it is desirable that they look as much like scale size replicas of the couplers on real, full-size railroad equipment as is practical.

Various attempts have been made over the years to devise a coupler that would allow automatic "hands off" operation. The oldest of these designs, still in wide spread use, is the so-called horn-hook design. In the horn-hook design, a hook shaped coupler is spring loaded so that when pushed into a similar hook on an adjacent model the hooks automatically cam aside, then slip into engagement, and there held by spring tension. Uncoupling is effected by inserting an uncoupling appliance into the track at a desired location. The uncoupling appliance engages pins built into the underside of the hooks when the models are run to that location for uncoupling.

In their current form, these horn-hook couplers are typically one piece plastic moldings with the spring molded integrally, and so are quite cost effective to manufacture. They do not, however, look much like the real object they are intended to represent. Furthermore, uncoupling can take place only at sites where an uncoupling appliance has been previously installed; the shape of the hooks preclude even the possibility of lifting the end of one model over the end of the other.

In an attempt to overcome these shortcomings, several designs of working knuckle automatic model couplers have been patented throughout the years. All have used the principle of a magnet installed in the track to effect uncoupling. Each design consists of several separate parts and springs which are assembled around a ferro-magnetic pin in such a way that the flux of the magnetic field of the magnet installed in the track opens the knuckle, thus causing uncoupling to occur. This system again requires preselected locations where uncoupling is to occur. Because of the multiple small parts and the assembly required, the manufacturing costs of these designs is many times more than the horn-hook coupler.

it is therefore an object of the present invention to provide a car coupler for model railroad cars which is simple in construction and easy to use.

It is yet another object of the present invention to provide a car coupler which, after being coupled, may be placed in an uncoupling state at any location along the track through the use of a portable uncoupling tool.

It is a further object of the present invention to provide a car coupler that is inexpensive to manufacture.

SUMMARY OF THE INVENTION

These and other objects of the invention are achieved in a drawbar for a coupler having a pair of shanks. One shank carries a lip and the other shank carries a knuckle. The shanks pivot relative to one another for performing a coupling and an uncoupling operation. A spring member is located at the proximal end of each shank for providing a bias force during coupling and uncoupling.

In one embodiment, a coupler consists of only two parts molded from plastic. The parts are large enough for assembly by the retail purchaser, thereby eliminating assembly cost. The two parts are spring loaded and pivot around a common post much like a scissors, engaging automatically when pushed into a like set on another model. The interior contour of the coupler is specifically designed to accept a "Switchman" uncoupling tool. The "Switchman" uncoupling tool is designed to be inserted between the models from above, and includes a flange to prevent the tool from extending through the couplers and snagging the track. Rotary motion applied to the tool causes the couplers to disengage, thereby allowing the models to be uncoupled at any point along the track system. The coupler contour is also designed to mate with most other knuckle type couplers presently in use.

BRIEF DESCRIPTION OF THE DRAWINGS

FIG. 3 is an exploded perspective bottom view of the drawbar of FIG. 1.

FIG. 4 is a top view of the drawbar of FIG. 1, positioned in a coupler box.

FIG. 6A is a perspective view of an uncoupling instrument for use with the drawbar of FIG. 1.

FIG. 6B is a top view of the uncoupling instrument of FIG. 6A.

FIG. 6C is a side view of the uncoupling instrument of FIG. 6A.

FIG. 6D is a cross-sectional view taken along A—A in FIG. 6B. FIG. 6E is a front view of the uncoupling instrument of FIG. 6A.

DESCRIPTION OF THE PREFERRED EMBODIMENT

Figure 1:
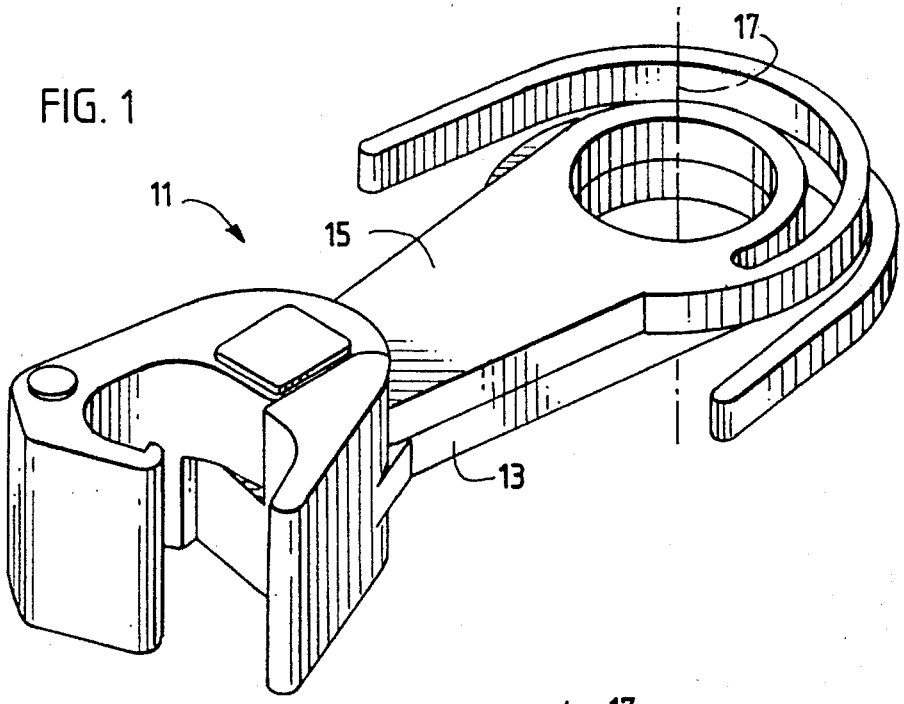
FIG. 1 is a perspective view of an embodiment of a drawbar for a model railroad coupler, according to the present invention.

Referring to FIG. 1, a model railroad car drawbar 11 is formed of a pair of planar shanks 13, 15. The shanks 13, 15 are independently rotatable relative to a pivot axis 17 established at the proximal ends of the shanks. The shanks are disposed adjacent one another and mate in sliding engagement during pivoting relative to axis 17.

Figure 2:
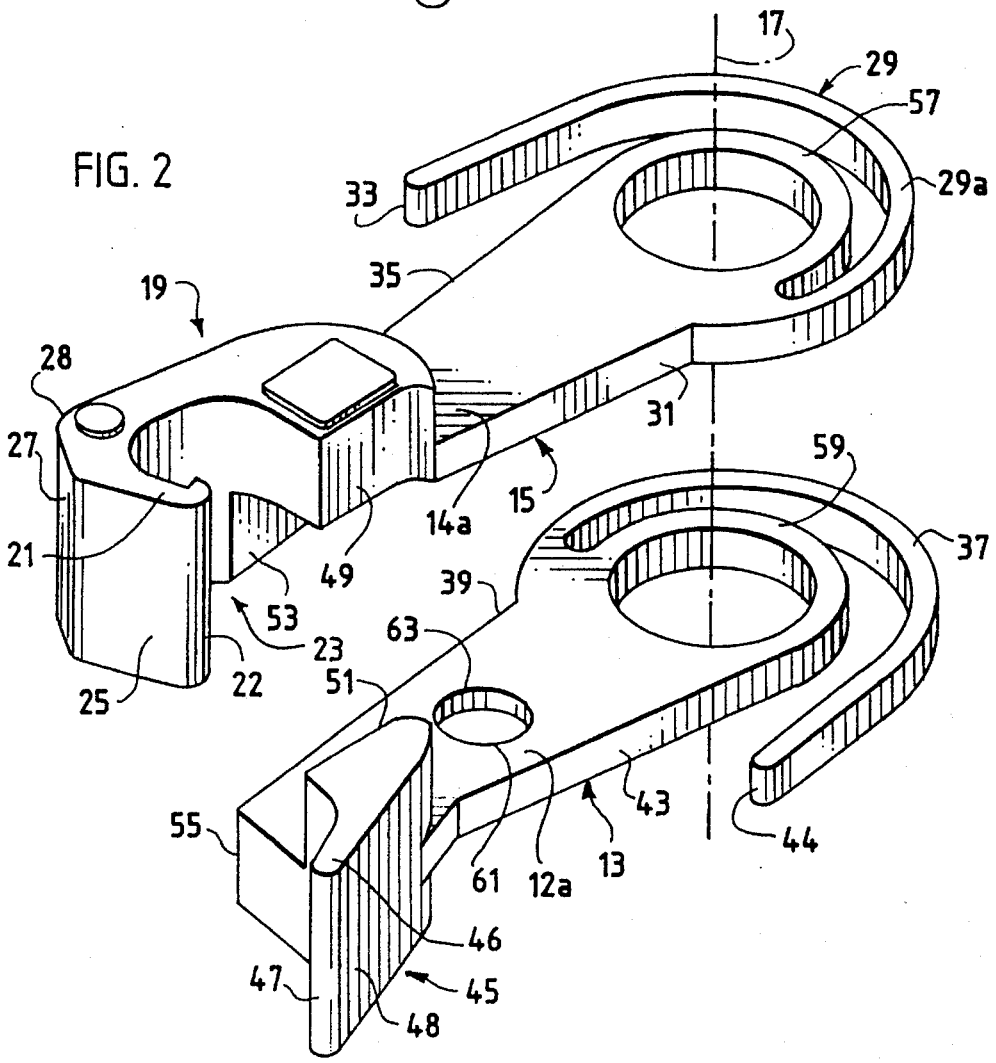
FIG. 2 is an exploded perspective top view of the drawbar of FIG. 1.

As shown in FIGS. 2 and 3, shanks 13, 15 are planar in that the shanks are shaped having a top planar surface 12A, 14A respectively (FIG. 2), and a bottom planar surface 12B, 14B respectively (FIG. 3). In use, shank 15 rests atop shank 13 (FIG. 1), and the planar bottom surface 14B (FIG. 3) of shank 15 engages the planar top surface 12A (FIG. 2) of shank 13. These shanks slidingly engage one another along these two surfaces 14B, 12A.

As shown in FIG. 2, a knuckle 19 is integrally molded to the distal end of shank 15. Knuckle 19 extends in height and depth both above and below the top and bottom planar surfaces 14A, 14B of shank 15. Knuckle 19 includes an extended hook 21 terminating in a rounded hook end 22. Hook 21 is shaped to form an open jaw area 23 of a size for receiving the terminating end of a like hook 21 (not shown in FIG. 2) disposed 180° in vertical rotation from hook 21.

The outer surface of knuckle 19 includes a pair of vertically disposed, planar cam surfaces 25, 27 and a curved cam surface 28. Cam surfaces 25, 27, and 28 cooperate with surfaces of a like drawbar (not shown) during coupling and uncoupling, as described hereinafter.

Cam surfaces 25, 27 are disposed orthogonal to the longitudinal plane of shank 15, i.e., orthogonal to the plane parallel to and spaced equidistance between surfaces 14A, 14B. As shown in FIG. 4, cam surfaces 25, 27, 28 form a continuous surface along the outside of knuckle 19. Cam surface 25 is disposed at an obtuse angle with respect to the shank axis 103, and cam surface 27 is disposed at an acute angle with respect to shank axis 103.

Referring again to FIG. 2, a spring member 29 is formed integral with and attached to the right side edge 31 of shank 15. Spring member 29 is planar in shape in that the spring member 29 is shaped having a top planar surface 29A (FIG. 2) and a bottom planar surface 29B (FIG. 3). Spring member 29 is disposed in the same plane as shank 15 in that surfaces 29A, 14A are coplanar and surfaces 29B, 14B are coplanar. Spring member 29 extends in a curved shape to substantially encompass pivot axis 17 and the proximal end of shank 15. Spring member 29 terminates in a rounded end 33 spaced from the left Side edge 35 of shank 15.

Shank 13 includes a similar spring member 37, but in mirror image relative to spring member 29, and formed integral with and attached to the left side edge 39 of shank 13. Similarly, spring member 37 is planar in shape and disposed in the same plane as shank 13 and terminates in a rounded end 41 spaced from the right side edge 43 of shank 13.

A lip 45 is integrally molded to the distal end of shank 13. Lip 45 extends in height and depth both above and below the top and bottom planar surfaces of shank 13. Lip 45 includes an extended finger portion 46 which extends distally to a rounded end 47. Lip 45 includes a planar outer surface 48 and a planar inner surface 50 (FIG. 4). Surfaces 48, 50 are orthogonal to the longitudinal plane of shank 15 and disposed at an acute angle with respect to shank axis 103.

Referring again to FIG. 2, knuckle 19 includes a planar stop surface 49 disposed orthogonal to the longitudinal plane of the shank and sized to mate with a planar stop surface 51 of the lip 45. Stop surface 51 is disposed orthogonal to the plane of shank 13 and, as shown in FIG. 1, abuts stop surface 49 when the two shanks are in a "closed" position, as shown in FIG. 1

In addition, knuckle 19 includes a second planar stop surface 53 for contact with a second planar stop surface 55 carried by lip 41. The second planar stop surfaces 53, 55 are orthogonal to the longitudinal plane of the shank. The mating abutment of stop surfaces 49, 51 and 53, 55 define the closed position of the two shanks.

Shanks 13, 15 include circular apertures 57, 59 of equal diameters and formed at the proximal ends of the shanks. Apertures 57, 59 have a circular cross section at the longitudinal plane of its respective shank and are established concentric with respect to the pivot axis 17.

Additionally, shank 13 includes a smaller circular indentation 61 centrally located on shank 13. Indentation 61 does not pass completely through the bottom surface of shank 13. The cylindrical wall 63 which defines indentation 61 provides a guide surface, as described hereinafter.

Referring again to FIG. 3, a guide boss 65 extends outwardly from shank 15 toward shank 13 for receipt into indentation 61 (FIG. 2) when shanks 13, 15 are disposed atop one another. Cylindrical wall 63 (FIG. 2) of indentation 61 engages boss 65 (FIG. 3) during movement of the shanks when an uncoupling occurs. As described hereinafter, the boss engages wall 63 during a portion of the movement of the shanks when uncoupling.

Boss 65 is in the form of a cylinder, but may take on other shapes. Indentation 61 may also take on other shapes as well. In addition, boss 65 and indentation 61 may be transposed between shanks 13, 15. The use of boss 65 and indentation 61 permits their contact while allowing engagement of shank surfaces 12A, 14B. The purpose of boss 65 and indentation 61 is to control the extent of the relative rotational movement of shanks 13, 15.

As shown in FIG. 4, drawbar 11 is pivotally mounted onto a cylindrical hub or boss 67 which defines rotational axis 17. Boss 67 is fixed relative to a box 69 formed of at least a pair of parallel side walls 71, 73. Spring members 29, 37 make contact with side walls 71, 73, respectively, compressing the spring members for providing a biasing force to its respective shank 15, 13. The biasing force drives the shanks to a closed position at the center line 75 of box 69. The spring members 29, 37 are sized and arranged relative to side walls 71, 73 such that the stop surfaces 49, 51 and 53, 55 are forced together causing alignment of the shanks with respect to the center line 75, as shown. In this closed position, knuckle 19 and lip 45 are engaged together.

Figure 5A:
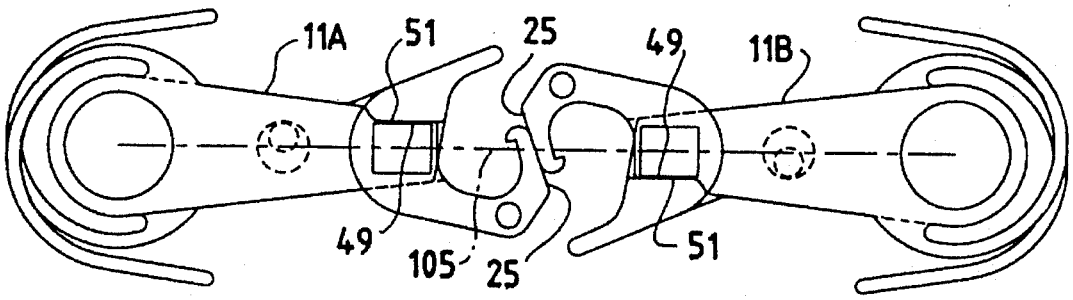
FIGS. 5A–5H are top views of two drawbars of FIG. 1, being shown in different relative positions during coupling.

Referring to FIG. 5A, a pair of like drawbars 11A, 11B meet for coupling. Drawbar 11B is moved along a center axis 105 toward drawbar 11A in the direction of arrow 101. The outer knuckle surfaces 25 engage initially as shown. The two shanks of each drawbar are initially in a closed position, with stop surfaces 49, 51 and stop surfaces 53, 55 in contact.

Figure 5B:
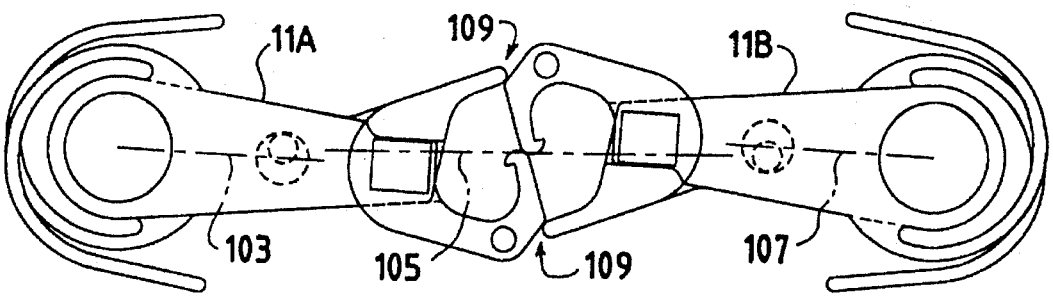

Referring to FIG. 5B, as drawbar 11B continues to be forced against drawbar 11A, drawbar 11A pivots laterally (clockwise) relative to the pivot axis, as indicated by shank axis 103 being offset from center axis 105. Drawbar 11B also pivots laterally, but in an opposite direction (counterclockwise) relative to the pivot axis, as the two knuckles slide relative to one another, as indicated by shank axis 107 being offset from center axis 105. The shanks of each drawbar maintain their closed position during lateral movement.

Figure 5C:
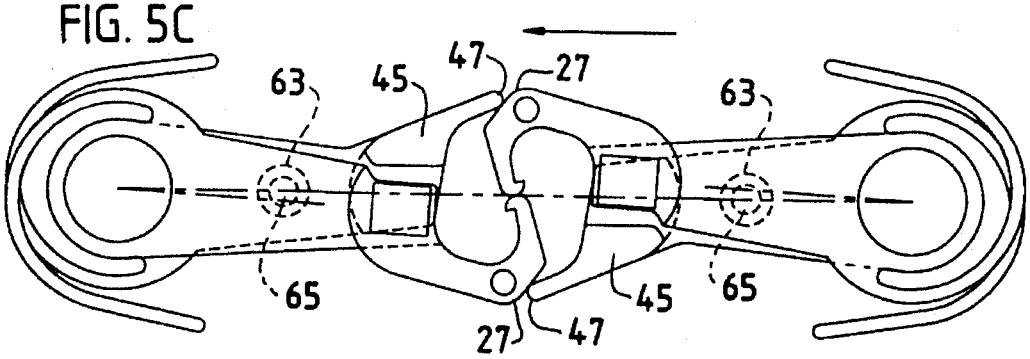

Referring to FIG. 5C, the two knuckles contact the lips 45 of the opposing drawbar. The rounded ends 47 of the lips are guided along cam surfaces 27 carried by the knuckles. The lip shanks 13 of each drawbar are forced open (laterally counterclockwise) from their associated knuckle shanks 15. The shanks thus open from their closed position, and bosses 65 move out of contact with guide surfaces 63.

Figure 5D:
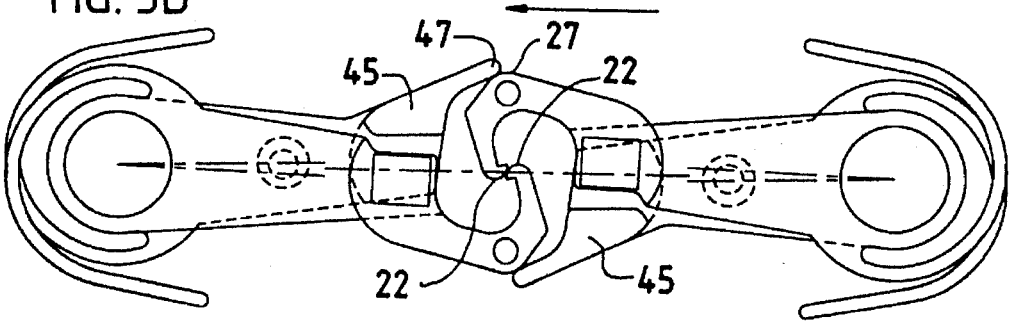
Figure 5E:
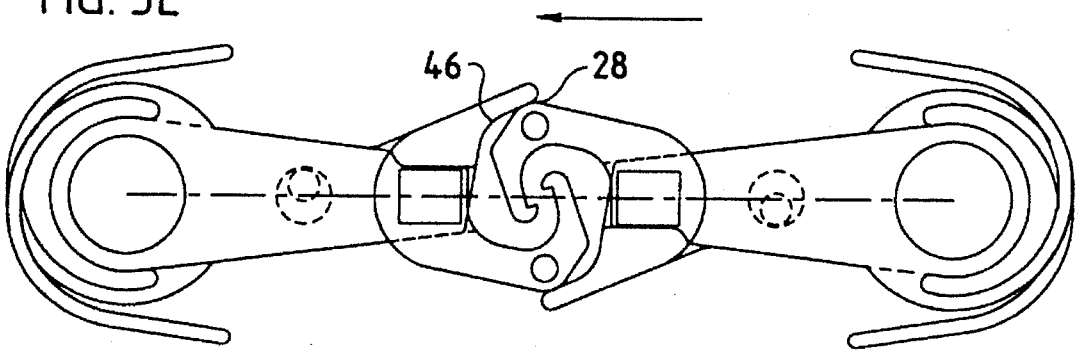

As the shanks open from their closed position, spring members 29, 37 flex against walls 71, 73 and bias the shanks back toward their closed position. As shown in FIG. 5D, the lip 45 of each drawbar eventually reaches a point on cam surface 27 where the spring force on lip 45 moves the two hook ends 22 laterally past one another as shown in FIG. 5E. At this point, lips 45 and knuckles 19 are forced together in their closed position via the bias of the spring members. The coupling process is now completed.

Figure 5F:
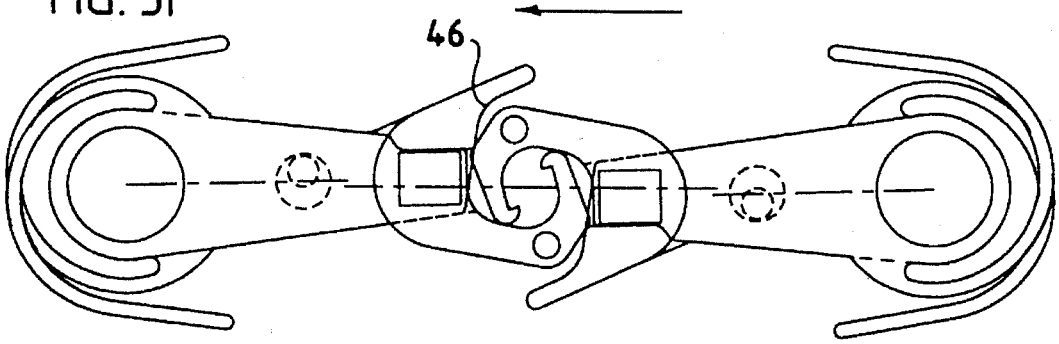
Figure 5G:
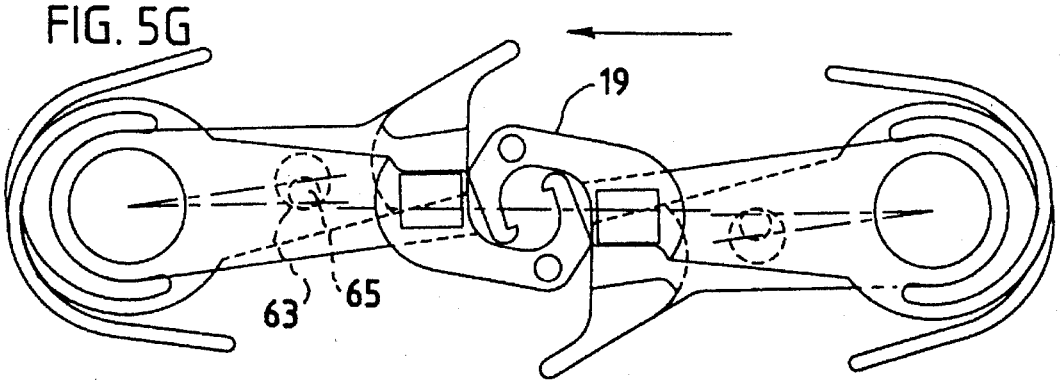
Figure 5H:
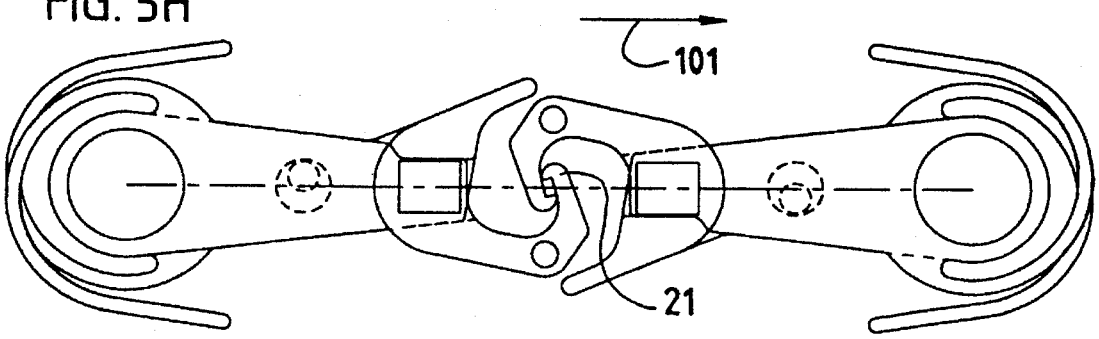

During the continued movement of the drawbar 11B caused by pushing against a train, the inner surface 46 of the lips guide the knuckles along the lip, as shown in FIGS. 5E and 5F. As shown in FIG. 5G, the knuckles meet the back side of the lips forcing the shanks open. Boss 65 now contacts guide surface 63, limiting the distance that the shanks can open. This maintains a solid surface for knuckles 19 to push against. If, at this point, the direction of movement of drawbar 11B is reversed, as indicated by arrow 101, the hooks 21 engage as shown in FIG. 5H. This is the coupled position.

Referring to FIGS. 6A–6C, an uncoupling tool 121 has a body formed of a handle 123 and a rod 125. A pointed tip 127 is formed integrally at the end of rod 125 for affecting uncoupling of the drawbars, as described hereinafter. As shown in FIGS. 6B and 6C, tip 127 begins at a distal point 129 and increases proximally in lateral width forming a cam segment 131 of greatest lateral width of the tip. As shown in FIG. 6D, the cross section of cam segment 131 is propeller shaped having a pair of triangular shaped segments 135, 137. Cam segment 131 is six-sided with portions of the sides serving as cam surfaces for promoting uncoupling, as described hereinafter with reference to FIG. 7. As shown in FIGS. 6C and 6E, cam segment 131 meets rod 125 in a circular flange 139 which assists in positioning cam segment 131 during uncoupling.

Figure 7A:
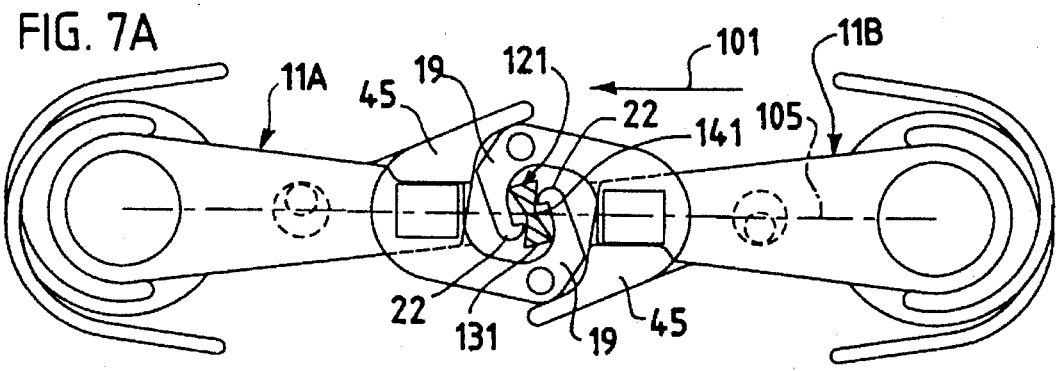
FIGS. 7A–7H are top views of two drawbars of FIG. 1, being shown in different relative positions during uncoupling.
Figure 7B:
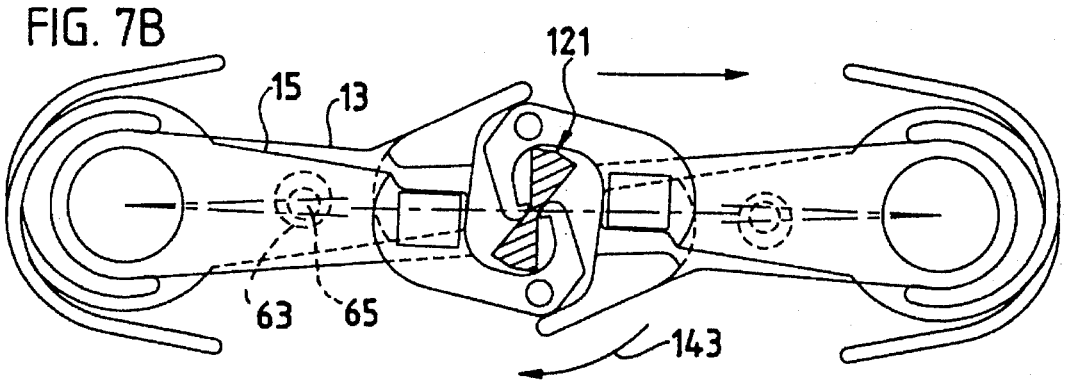

Referring now to FIG. 7A, drawbars 11A, 11B are decoupled using uncoupling tool 121. Drawbar lib is moved along center axis 105 in the direction of arrow 101. The knuckles 19 move against the inner surfaces of lips 45 of the opposing drawbars leaving a space 141 between the hook ends 22 for insertion of uncoupling tool 121. Initially, the point 129 and a portion of the cam segment of the tool enters the space 141.

As shown in FIG. 75, the uncoupling tool 121 is rotated clockwise as indicated by arrow 143, as the drawbar lib is moved away from drawbar 11A, as indicated by arrow 101. As the uncoupling tool is rotated, it is also moved downwardly to the full-depth of cam segment 131 causing flange 139 (FIG. 6C) of the uncoupling tool to abut against the top surface of the hooks. At full depth between the hooks, cam segment 131 presents its greatest lateral width between the hooks. As tool 121 is rotated, shanks 13, 15 Of each drawbar open, moving hook ends 22 away from lips 45.

Figure 7C:
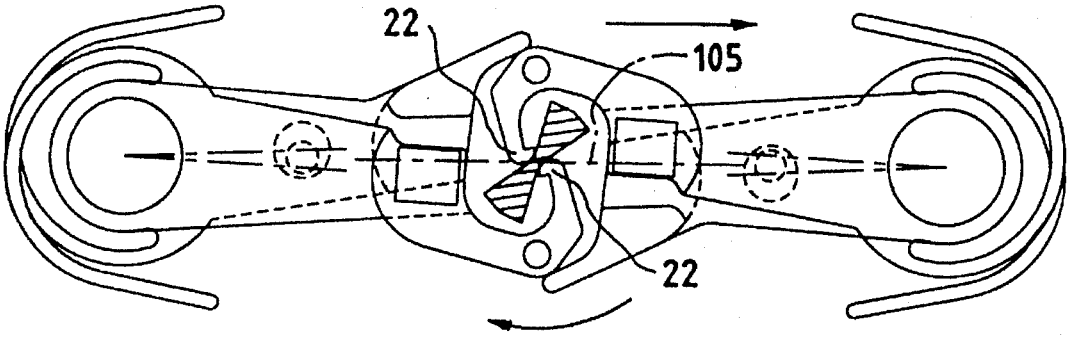
Figure 7D:
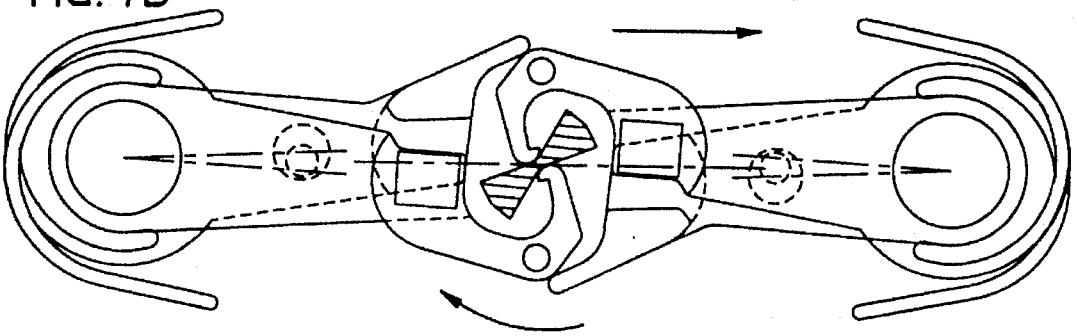
Figure 7E:
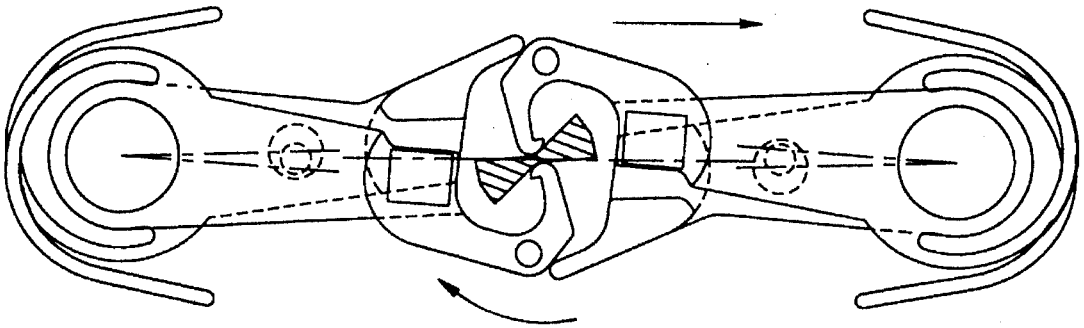
Figure 7F:
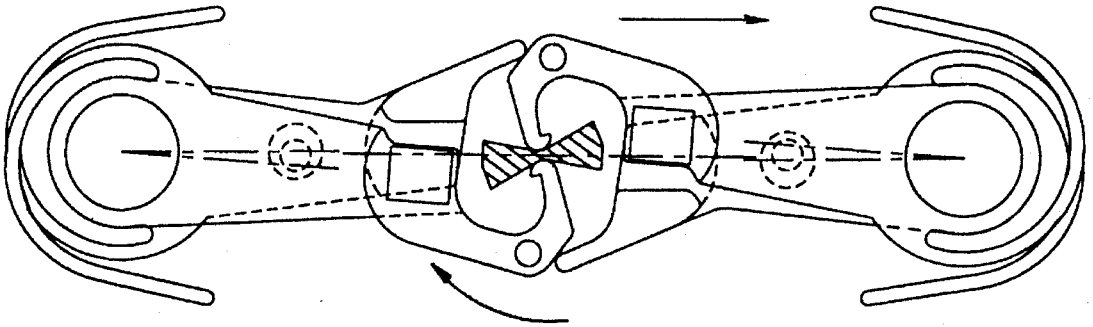
Figure 7G:
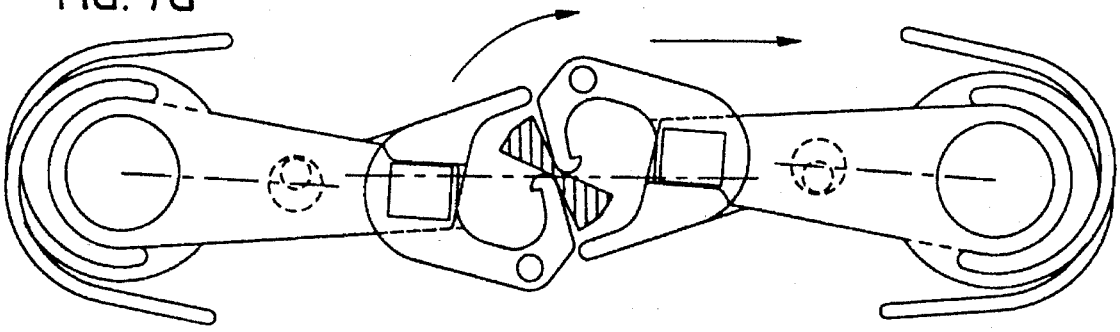
Figure 7H:
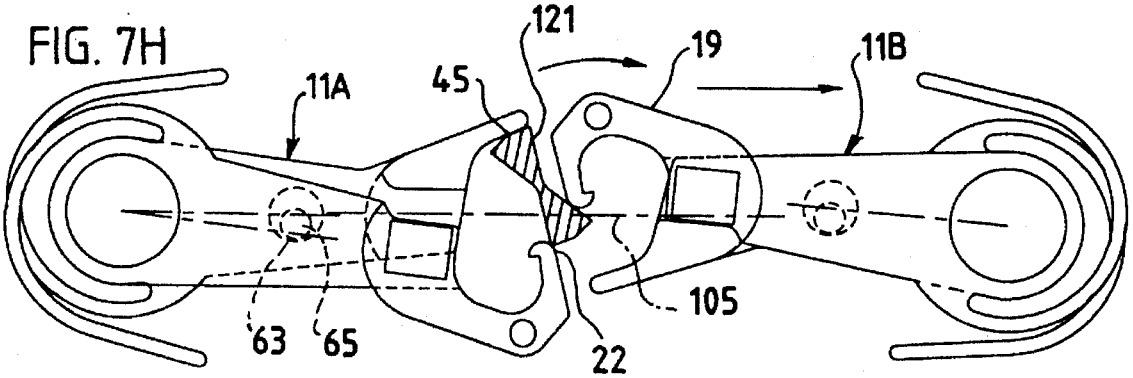

As shown in FIG. 7C, the uncoupling tool 121 continues to be rotated forcing the hook ends 22 laterally off the center axis 105. As shown in FIGS. 7D–7G, tool 121 continues to be rotated decoupling the drawbars and allowing the shanks 13, 15 to move to their closed position. As shown in FIG. 7H, the uncoupling tool is shaped wide enough so that it cannot rotate fully in the distance between hook end 22 and lip 45. This distance is limited by the contact of boss 65 with guide surface 63. This insures that knuckle 19 of drawbar 11B is expelled from drawbar 11A as tool 121 completes its rotation, thus completing the uncoupling process.

Figure 8A:
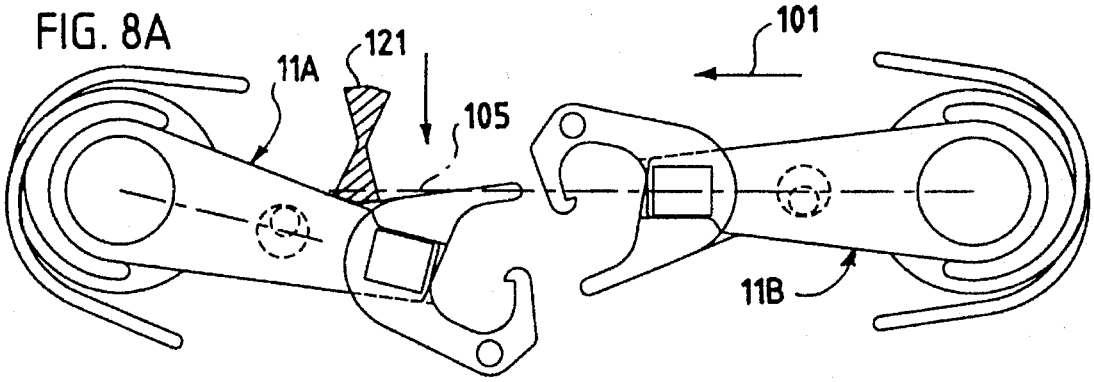
FIGS. 8A–8D are top views of two drawbars of FIG. 1, being shown in different relative positions after uncoupling has been accomplished.
Figure 8B:
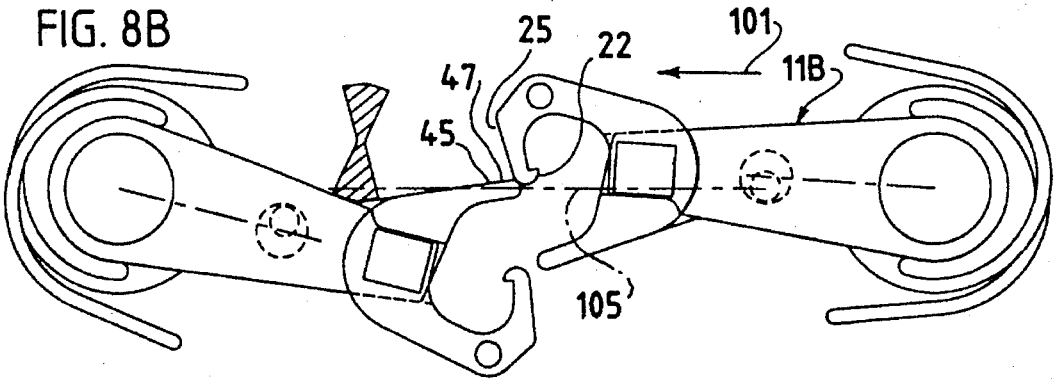
Figure 8C:
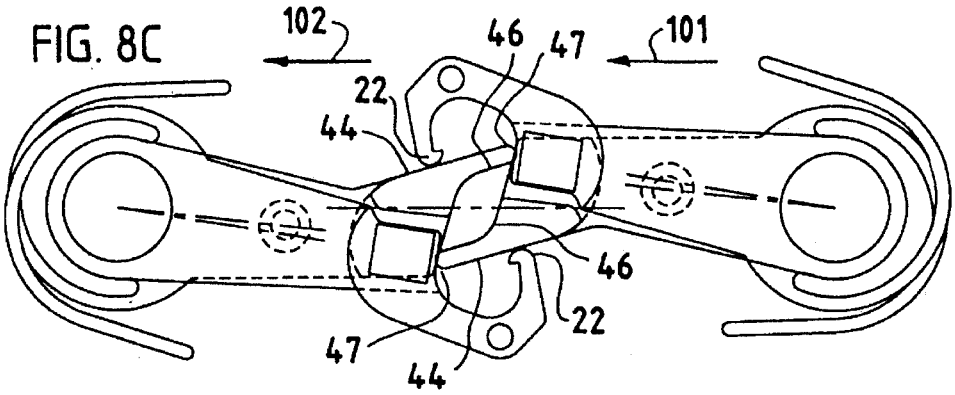
Figure 8D:
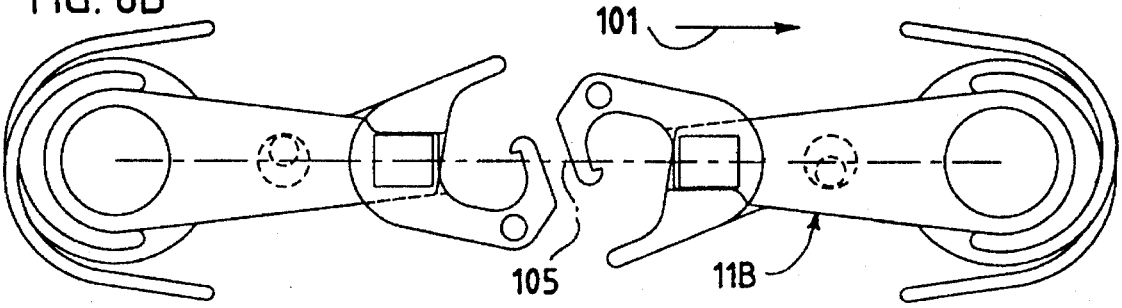

Referring to FIG. 8A, uncoupling tool 121 may be placed against drawbar 11A and force applied to move drawbar 11A laterally off center axis 105. When drawbar 11B is moved as indicated by arrow 101 toward drawbar 11A, rounded end 47 of lip 45 slides along cam surface 25 of hook 21, camming drawbar 11B off center axis 105 until round end 47 of lip 45 slips past hook end 22, as is illustrated in FIG. 8B. In FIG. 8C, it can be seen that continued motion in the direction indicated by arrow 101 causes outer surface 44 of lip 45 to slide past hook end 22 until it contacts the inner surface 46 of the opposing drawbar, which then will also begin to move as indicated by arrow 102. By this means it is possible to push a piece of model equipment beyond the location at which the decoupling was performed without re-coupling occurring. Referring to FIG. 8D, when drawbar 11B is withdrawn in the direction indicated by arrow 101, the springs return both drawbars to the center axis 105, properly positioned for the next coupling.

Figure 9:
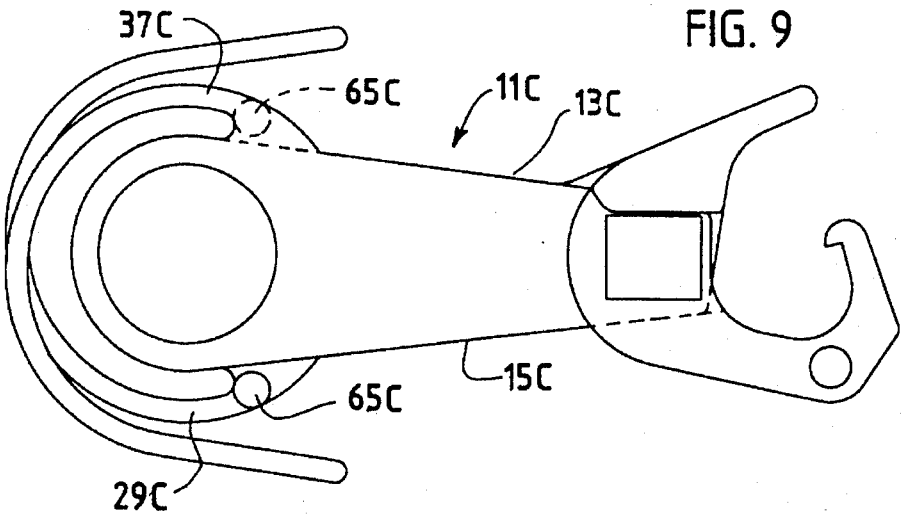
FIGS. 9–11 are top views of additional embodiments of a drawbar for a model railroad coupler.

Referring now to FIG. 9, a second embodiment drawbar 11C is shown. Each of the shanks 13C, 15C include a boss 65C which is disposed on springs 29C, 37C and spaced from the side edges of the shanks. Bosses 65C control the relative rotational extent of shanks 13C, 15C. The outer edge of each shank contacts a boss 65C to stop its relative rotational movement as the shanks move to their fullest open position.

Figure 10:
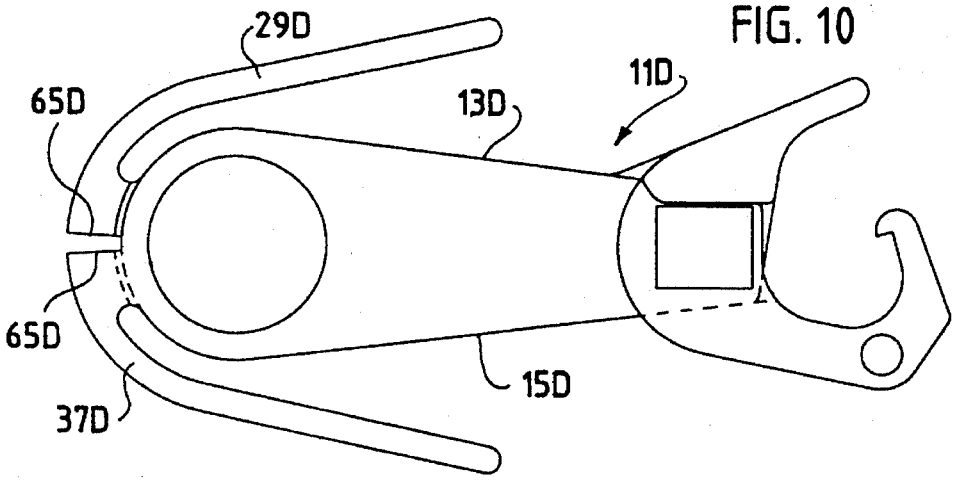

A third embodiment drawbar 11D is shown in FIG. 10. The lip shank 13D includes a spring 37D and the knuckle shank 15D includes a spring 29D. Springs 29D, 37D are attached or formed integrally to their respective shank at a proximal position on the shank. The springs are shaped with less curvature than the springs 29, 37 of the first embodiment of FIG. 1. A pair of spring edges 65D are spaced apart and make abutting contact with one another as the shanks rotate to a certain open position, and thus the edges stop further rotation of the shanks.

Figure 11:
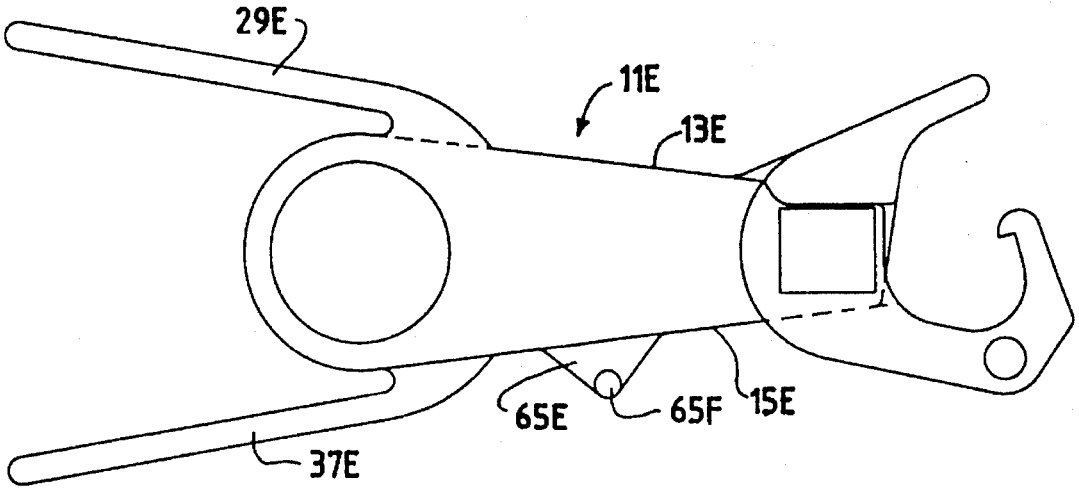

A fourth embodiment drawbar 11E is shown in FIG. 11. The lip shank 13E includes a projection 65E and a boss 65F. Boss 65F makes contact with the edge of knuckle shank 15E to stop the relative rotational movement of the two shanks to their fullest open position. Springs 29E, 37E are attached along the edges of their respective shanks and extend proximally past the proximal end of the shanks, as shown.

Drawbar 11 may be molded from plastic. Each shank with its associated spring, knuckle or lip, boss or indentation, may be molded from plastic as a single piece.

What is claimed is:

1. A model railroad car drawbar comprising:

a first and second shank shaped for disposition adjacent one another and independently rotatable relative to a pivot axis, said first and second shanks being pivotable about said axis into a closed position;

a pivot pin opening located at a proximal end of each of said shanks, each said opening defining said pivot axis;

a knuckle located at a distal end of said first shank, said knuckle comprising a hook shaped to couple with a like hook disposed at 180° thereto;

a lip located at the distal end of said second shank, said lip occupying a position relative to said hook when said shanks are in said closed position for engaging the like hook during coupling;

a first spring member located at the proximal end of said first shank for providing a force to said first shank to bias said first shank to pivot into said closed position; and a second spring member located at the proximal end of said second shank for providing a force to said second shank to bias said second shank to pivot into said closed position.

2. A model railroad car drawbar according to claim 1 and further including control means for controlling the extent to which said first and second shanks are moved relative to one another.

3. A model railroad car drawbar according to claim 2 wherein said control means comprises a boss extending outwardly from said first shank toward said second shank; and a guide surface carried by said second shank at a position relative to said boss and shaped for contacting said boss during at least a portion of movement of said shanks.

4. A model railroad car drawbar according to claim 1 wherein said drawbar is mountable within a box formed of at least two parallel walls and defining a longitudinal axis between said walls, and wherein said first and second spring members engage the inner surface of said walls of said box to provide a bias to align said first and second shanks along the longitudinal axis of said box and to force said shanks into said closed position.

5. A model railroad car drawbar according to claim 1 wherein said knuckle includes a stop surface and wherein said lip includes a stop surface, said stop surfaces contacting one another when said shanks are in said closed position.

6. A model railroad car drawbar according to claim 1 wherein said shanks are planar in configuration, said first shank has a lower planar surface and said second shank has an upper planar surface, said planar surfaces slidingly engaging during coupling.

7. A model railroad car drawbar according to claim 1 wherein said pivot pin opening of each of said shanks is circular.

8. A model railroad car drawbar according to claim 1 wherein said knuckle includes a hook end and a camming surface located on the outer surface of said knuckle.

9. A model railroad car drawbar according to claim 8 wherein said camming surface is planar and disposed at an angle relative to the longitudinal axis of said first shank.

10. A model railroad car drawbar according to claim 9 wherein said knuckle includes another camming surface, said another camming surface is planar and disposed at an angle to said first named camming surface.

11. A model railroad car drawbar according to claim 10 wherein,said lip includes a finger portion having an inner guide surface for engagement with said another camming surface of the like hook during coupling.

12. A model railroad car drawbar according to claim 1 wherein said lip includes a finger portion having an inner guide surface for engagement with the like hook during coupling.

13. A model railroad car drawbar according to claim 1 wherein said first spring member is planar and of the same thickness as said first shank.

14. A model railroad car drawbar according to claim 1 wherein said first spring member is molded integrally with said first shank.

15. A model railroad car drawbar according to claim 1 wherein said first spring member is curved in shape, extending from one side of said first shank and encompassing the proximal end of said first shank and terminating at a point spaced from the side of said shank opposite said one side.

16. A model railroad car drawbar according to claim 15 wherein said second spring member is shaped like said first spring member and disposed relative thereto as a mirror image of said first spring member when said shanks are disposed adjacent one another about said pivot axis.

17. A model railroad car coupler comprising:

a box formed of at least two wall members;

a pivot boss disposed within said box and defining a pivot axis;

a first and second shank disposed adjacent one another and pivotally mounted on said pivot boss, said shanks being independently rotatable relative to said pivot axis, said first and second shanks pivotable about said axis into a closed position;

a knuckle located at the distal end of said first shank, said knuckle comprising a hook shaped to couple with a the like hook disposed at 180° thereto;

a lip located at the distal end of said second shank, said lip occupying a position relative to said hook when said shanks are in said closed position for engaging the like hook during coupling;

a first spring member located at the proximal end of said first shank and engaging one of said wall members for providing a force to said first shank to bias said first shank to pivot into said closed position; and a second spring member located at the proximal end of said shank and engaging the other one of said wall members for providing a force to said second shank to bias said second shank to pivot into said closed position.

18. A model railroad car coupler according to claim 17 and further including a first control member on said first shank and a second control member on said second shank, said first and second control members disposed on said shanks at locations for cooperative contact therebetween during a portion of the movement of the shanks for controlling the extent to which said first and second shanks are moved relative to one another.

19. A model railroad car coupler according to claim 18 wherein said first control member comprises a boss extending outwardly from said first shank toward said second shank; and wherein said second control member comprises a guide surface carried by said second shank at a position relative to said boss and shaped for contacting said boss during at least a portion of movement of said shanks.

20. A model railroad car uncoupler according to claim 17 wherein said first shank, said knuckle and said first spring member are molded from plastic as one unitary piece; and wherein said second shank, said lip and said second spring member are molded from plastic as one unitary piece.

* * * * *